US006796115B1

(12) United States Patent
Patrick

(10) Patent No.: US 6,796,115 B1
(45) **Date of Patent: *Sep. 28, 2004**

(54) NEEDLE PUNCHED YARNS

(76) Inventor: Gilbert Patrick, 635 Dixon School Rd., Kings, Mountain, NC (US) 28086

( * ) Notice: Subject to any disclaimer, the term of this patent is extended or adjusted under 35 U.S.C. 154(b) by 51 days.

This patent is subject to a terminal disclaimer.

(21) Appl. No.: 10/025,679

(22) Filed: Dec. 19, 2001

(51) Int. Cl.[7] ..... D02G 3/22
(52) U.S. Cl. ..... 57/210; 57/236; 28/107
(58) Field of Search ..... 57/236, 200, 210, 57/211, 224, 225, 226, 227, 228, 230, 231, 235, 243, 244, 252, 255, 256, 259, 260; 28/107, 247, 253

(56) References Cited

U.S. PATENT DOCUMENTS

| | | | | | |
|---|---|---|---|---|---|
| 2,783,609 | A | | 3/1957 | Breen | 57/140 |
| 2,974,393 | A | | 3/1961 | Hollowell | 28/4 |
| 3,208,125 | A | * | 9/1965 | Hall et al. | |
| 3,535,756 | A | | 10/1970 | Kuts et al. | 28/4 |
| 3,681,822 | A | | 8/1972 | Sanders | 28/4 |
| 3,729,920 | A | | 5/1973 | Sayers et al. | 57/144 |
| 3,772,115 | A | | 11/1973 | Carlson et al. | 156/148 |
| 3,906,599 | A | | 9/1975 | Smith, II | 28/72.2 |
| 4,170,868 | A | | 10/1979 | Chambley et al. | 57/293 |
| 4,555,424 | A | | 11/1985 | Reim et al. | 428/91 |
| 4,674,271 | A | * | 6/1987 | Bird | |
| 4,891,870 | A | | 1/1990 | Muller | 28/107 |
| 4,935,295 | A | | 6/1990 | Serafini | 428/286 |
| 5,057,173 | A | | 10/1991 | Bihy et al. | 156/148 |
| 5,081,753 | A | * | 1/1992 | Fink et al. | |
| 5,140,722 | A | | 8/1992 | Akiyama | 19/150 |
| 5,287,690 | A | * | 2/1994 | Toon | |
| 5,390,399 | A | | 2/1995 | Dilo | 28/109 |
| 5,896,633 | A | | 4/1999 | Fehrer | 28/107 |
| 6,029,327 | A | | 2/2000 | Sheehan et al. | 28/107 |
| 6,114,262 | A | * | 9/2000 | Groh et al. | |
| 6,311,375 | B1 | * | 11/2001 | Patrick | |
| 6,481,071 | B1 | | 11/2002 | Fehrer et al. | 28/107 |
| 2001/0049869 | A1 | | 12/2001 | Fehrer | 28/107 |
| 2002/0038499 | A1 | * | 4/2002 | Fehrer | |
| 2002/0059707 | A1 | | 5/2002 | Fehrer | 28/107 |
| 2003/0000056 | A1 | | 1/2003 | Fehrer | 28/247 |

FOREIGN PATENT DOCUMENTS

| | | | |
|---|---|---|---|
| EP | 0 445 872 B1 | 12/1996 | D02G/3/12 |

OTHER PUBLICATIONS

Kathryn L. Hatch, Textile Science 1993, West Publishing Company, 1st edition, p. 90.*
Kathryn L. Hatch, Textile Science 1993, West Publishing Company, 1st edition, p. 268, 269, 302–305.*

* cited by examiner

*Primary Examiner*—Gary L. Welch
*Assistant Examiner*—Shaun R Hurley
(74) *Attorney, Agent, or Firm*—Womble Carlyle Sandridge & Rice, PLLC

(57) ABSTRACT

A process for producing yarns that have enhanced resistance to unraveling and linting, wherein the yarns are moved along guides through a needle loom where a series of needles engage the yarns. This engagement of the yarns by the needles causes the fibers of the yarns to become intermixed.

16 Claims, 2 Drawing Sheets

NEEDLE PUNCHED YARNS

FIELD OF INVENTION

The present invention generally relates to the processing of yarns, in particular, the present invention relates to spun filament or fiber yarns processed through a needling process to interlock or link the yarn filaments or fibers together.

BACKGROUND OF INVENTION

In yarn manufacturing, yarns generally are spun from one or more fibers, including natural and/or synthetic fibers, using conventional ring, open-end, air-jet, worsted, woolen, or Dref spinning processes. The yarns then are used in a single form or ply or are plied together with other yarns or filaments to produce a single but bigger yarn. One of the principal problems with spun formed yarns generally is the tendency of such yarns to unravel or fray when cut, and, depending upon the method of spinning, such yarns generally will have inherently low abrasion qualities. To try to solve this problem it has generally been known to add a low-melt fiber or filament, as a percentage, into the mass yarn bundle. Thereafter, following completion of the spinning and/or twisting process, when the yarns are processed through a heat-set range, they are generally exposed to temperatures and dwell times that melt the low-melt fibers into an adhesive that bonds the fibers and/or plies of the yarn(s) together. Other methods of solving the unraveling or fraying problem typically consist of adding adhesives to the finished yarn in a costly after-process that also tends to deter their natural surface characteristics.

One example of yarn products where the problem of unraveling and/or diminishment of surface characteristics are especially problematic is mops. Mops usually consist of one or more spun yarns containing cotton and/or other fibers of good absorption and abrasion properties, twisted as a single yarn in a Z rotation. These yarns are then grouped or plied with 2 to 32 ends of the same type yarn or other yarns of different structures or compositions and are twisted in an opposite rotation until the yarn is balanced. Such yarns generally have good absorption properties and are preferred in the janitorial field. However, by their inherent structure, these mops typically tend to unravel or lint as they are used. This shortens the usable life for the mop and tends to cause lint to be distributed on and thus diminish the finish of cleansed surfaces.

To combat this, mops made of non-woven strips have been introduced into the market. These strips are manufactured by carding and forming a fiber mass and adhering it together by adhesives or by thermal bonding. This process, however, tends to diminish or lessen the absorption properties of the mop. Further, while the use of many synthetic fibers has yielded products, such as mops, that have good abrasion properties, such products often do not have good absorption or wicking properties, particularly where the fibers are pressed or tightly linked together.

It is therefore seen that a need exists for an economical means of interlocking fibers and plies of spun yarns or filaments together to form yarns that exhibit better abrasion resistance and wicking, do not unravel as quickly, and have a longer usable life.

SUMMARY OF THE INVENTION

The present invention is directed to the formation of yarns, cordage and/or fibrous mats or bundles having enhanced strength and resistance to unraveling, and which link the properties of both spun yarns or fibers having, for example, good absorption, to other materials such as non-woven strips having, for example, good abrasion properties, but low absorption. The resultant spun yarns, therefore, will be provided with the enhanced absorption properties of a natural or woven fiber yarn and the durable and less-linting properties of a non-woven material yarn.

Typically, the yarns are spun from a series of natural and/or synthetic fibers to form a yarn bundle or fibrous mass, and generally include core fibers wrapped or covered with sheath fibers. The yarns are fed from creels or beams along a feed path into a loom or needling apparatus or system, being pulled through the loom under tension. The yarns are each fed along a milled groove of a needle plate of the loom. Each groove has sloped sides defining a guide channel that is aligned with the feed path and a centerline of each of the yarns, and which direct the yarns downwardly and toward the center of the guide channels, so that their centerlines are aligned along the feed path as the yarns are moved through the loom.

The loom generally includes a drive plate or carrier that is reciprocally driven toward and away from the yarns passing through the grooves of the needle plate. A series of needles are arranged in spaced, parallel rows or lines of needles on the drive plate, with each of the needles typically having one or more barbs adapted to catch or pull portions of the core and sheath fibers of the yarns through the yarns as the needles are reciprocated into and out of the yarns. Each row of needles is aligned substantially directly perpendicular to the centerline of one of the yarns in the grooves so as to penetrate the yarns substantially along their centerlines and pull fibers through the yarns to substantially intermix and interlock the core and sheath fibers of the yarns. The grooves of the needle plate typically are formed with sufficient depth and slope to enable additional yarns to be stacked therein with the yarns maintained substantially parallel with their centerlines in alignment with a row of needles. The guide channels further can be arranged in substantially flat, straight configurations, or curved or arcuate configurations or construction with the needles likewise being carried by a drive plate having a similar shape or configuration so that rows of needles substantially matches that of the guide channels.

In a further embodiment, a fibrous mat can be fed along or over the yarn guides, being run parallel to the yarns for needling and attaching the yarns to a fibrous mat. Strips of material also can be attached to the yarns by positioning the strips over the yarns in the guide channels of the needle plate so that as the needles pierce the fibrous strips or webs and the yarns, fibers from the yarns, and the strips or webs are intermixed and become substantially interlocked so as to form a composite yarn/strip. As a result, composite material strips, and/or mats can be formed which incorporate different properties of one or more different types of yarns, such as, for example, combining the absorbency of a cotton or similar natural fiber yarn with the abrasive properties of a synthetic or man-made fiber, so as to create a yarn that has high absorbency and good abrasive capabilities but which does not have a tendency to lint or unravel easily, especially after repeated exposure to water and other liquids.

Various objects, features and advantages of the present invention will become apparent to those skilled in the art, upon a review of the following detailed description, when taken in conjunction with the accompanying drawings.

DETAILED DESCRIPTION

The present invention relates to needle-punched yarns 10 (FIG. 1), cordage and fiber mats or bundles having improved or enhanced natural properties relating to strength, absorption, resistance to unraveling, and linting, and for desired aesthetic patterned appearances or features. The yarn typically is a spun yarn in a multi-ply or single-ply form, and generally includes one or more core fibers or filaments, or a series or mass of fibers 11 not necessarily having or requiring a core fiber. A covering or wrapping of cover or sheath fiber(s) 12 are wrapped or spun around and substantially cover the core fiber(s) to form the fibrous mass or yarn bundle. The yarns generally can be spun by means of ring, open-end, worsted, woolen, air-jet, or any other type spinning process, can include carded webs or fibers such as a worsted carded web or can be spun or carded in a synthetic filament form, however, it has been found that the more disoriented the fibers are in the yarn, the more effective the present invention. Dref or friction spun yarns further generally display a greater degree of improvement than open-end, ring spun, or vortex spun yarns, although such other types of yarns also can be used in the present invention. The core and sheath fibers of the yarns can be composed of natural fibers, such as cotton, wool, and the like; manmade or synthetic fibers, such as nylon, aramids, polypropylenes, polyesters, rayon, acrylics, polyethelenes, para-aramids, plastics and the like; or combinations thereof, and typically consist of micro-denier fibers up to coarse fibers of approximately 15–20 denier.

Figure 2:
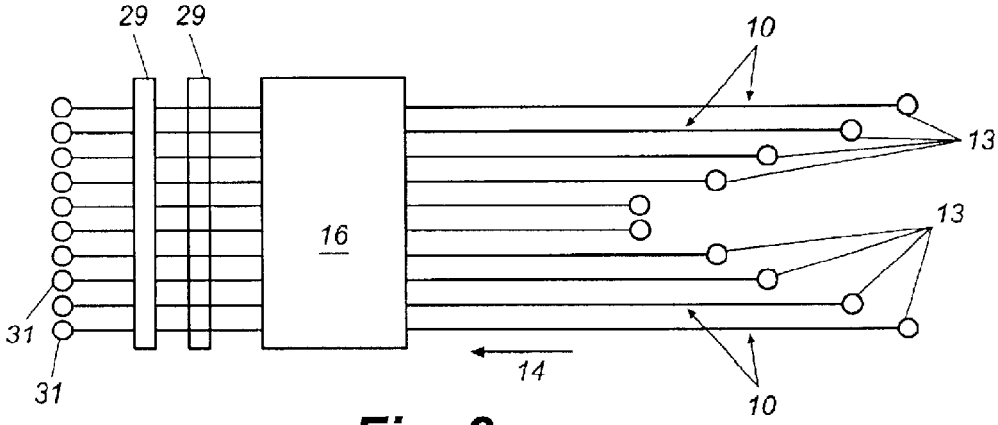
FIG. 2 is a schematic view illustrating the feeding of yarns from yarn creels through a loom.
Figure 3:
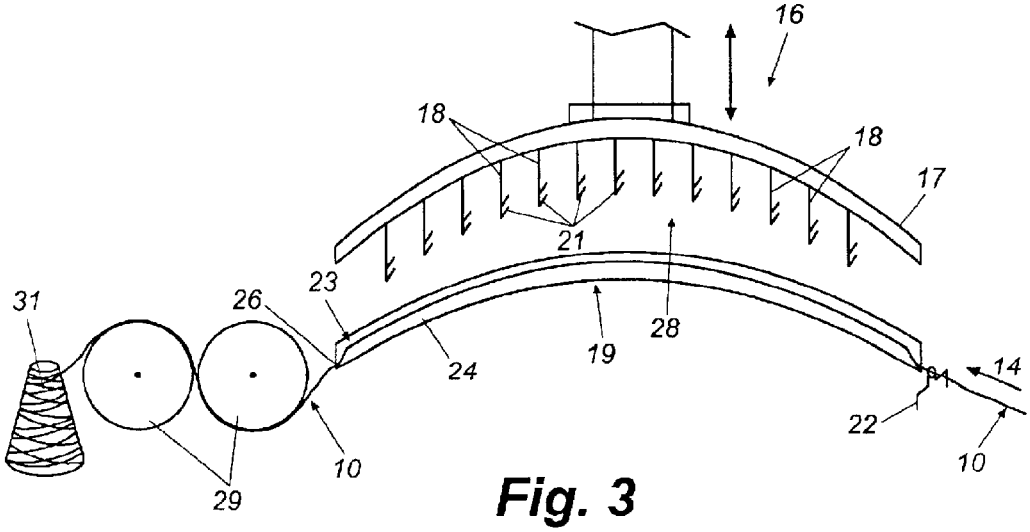
FIG. 3 is a side elevational view, schematically illustrating the passage of a yarn through one of the yarn guides for engagement by the needles of the present invention.
Figure 4:
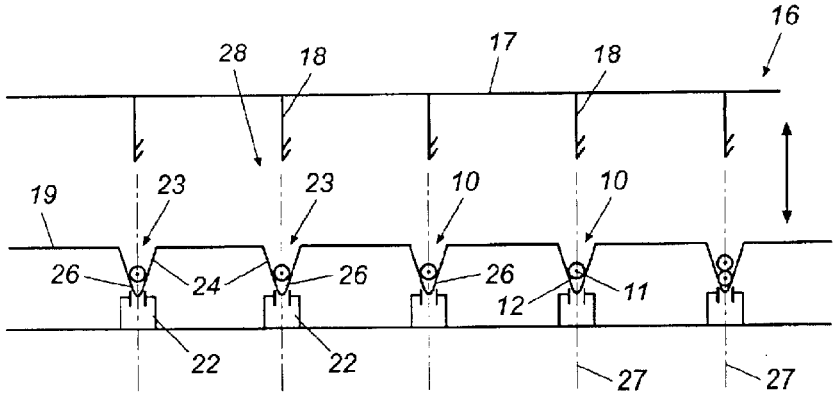
FIG. 4 is an end view illustrating the movement of yarns through the yarn guides, with the needles being substantially aligned along the centerlines of the yarns.

As shown in FIG. 2, the yarns generally are fed from creels 13 along a feed path 14 into a needle loom 16, either as single ends off of creel cones 13 or incorporated together as on a beam. The loom 16 typically is a needling loom such as a Fehrer H-1 needle loom or similar needling apparatus or system. As shown in FIGS. 3 and 4, the loom 16 generally includes a reciprocably moving needle carrier or drive plate 17 that carries a series of needles 18, and a needle bed plate 19 positioned directly below the carrier or drive plate 17. The needles generally are polished needles having one or more barbs 21 and a polished surface, and are arranged in defined, spaced rows or lines of needles along the length of the carrier 17. The spacing of the needles generally ranges from about 5 mm to about 10 mm, typically approximately 7 mm, although spacings of less than 5 mm and greater than 10 mm also can be used, with the rate of advance of the yarns generally determined by the spacing such that the yarns are typically advanced a distance per each needle stroke approximately equal to the needle spacing. The spacing of the needles and the feed rates of the yarns passing along the needle plates can be varied, as can the size and number of barbs of each needle, to vary the engagement of the fibers of the yarns by the needles.

As the yarns enter the loom, each yarn end is fed along its fed path 14 into and along a ceramic or plastic yarn guide 22 (FIG. 3), such as an eyelet or other, similar type of guide, with the yarns fed under tension so as not to get tangled up with neighboring yarns. As the yarns enter the yarn guide 22 (FIGS. 3–4) the yarns are each directed into milled grooves 23 that have been milled or formed in the needle bed plate 19 (FIG. 3) of the loom. The grooves are formed with sloping sides 24 that define guide channels 26 along which the yarns are moved with the centerlines 27 of each of the yarns being aligned parallel to each other and the feed path 14. The yarns generally are kept taut or under tension in the grooves with a changeable/variable positive draft as they are drawn through a needling zone 28, such as by using tension rolls 29 to pull the yarns through the loom. The yarn guides further generally are positioned lower than the milled grooves 23 so the tension applied to the yarns keeps each yarn within its respective groove.

As indicated in FIG. 4, the needles 18 of each line of needles on the carrier or drive plate are positioned so that they are directly perpendicular with an axis or centerline 27 of one of the yarns traveling through one of the grooves of the needle bed. This ensures that the barbs of the needles will penetrate substantially through the cores 11 and sheath fibers 12 of the yarns and not through the edges of the yarns where the needles could miss the cores and thus the needling would be less effective and would also tend to cause fuzzing or distortion of the yarn. As the needles penetrate the centerlines of the yarns, the barbs of the needles tend to urge and engage and pull fibers from the core and sheath fibers through the body of the yarn, i.e., through the core and sheath fibers, so as to cause an intermixing of these fibers. Thus, portions of the core and sheath fibers become intertwined and thus interlocked to create a yarn that is generally more resistant to unraveling and linting, even when cut and/or exposed to liquids, since the fibers are locked together, without requiring application of adhesives or expensive after processing to set the yarns, which later processes and additives can also affect the material properties of the yarns. It has also been found that if the yarn is pulled from individual packages, and unwound from the top of the cone or tube, the natural tendency of the yarn to twist as it proceeds through the needle loom amplifies the effectiveness of the needle penetration therethrough.

Figure 1:
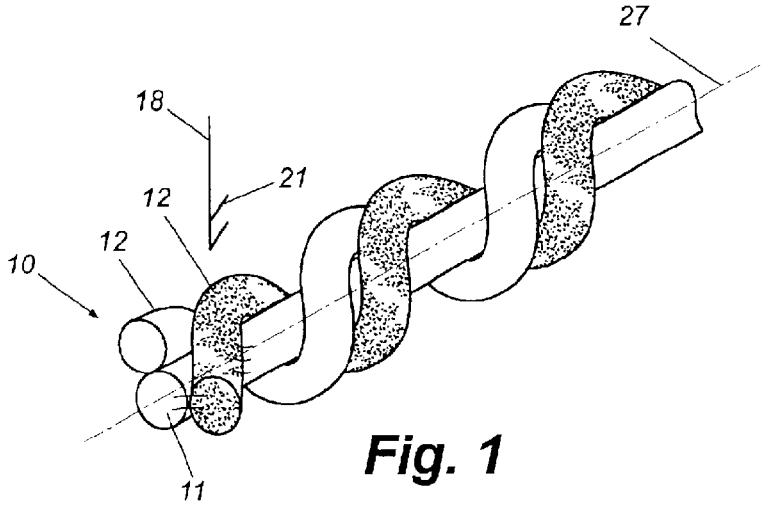
FIG. 1 is a perspective view of a yarn, illustrating the core and sheath fibers.
Figure 5A:
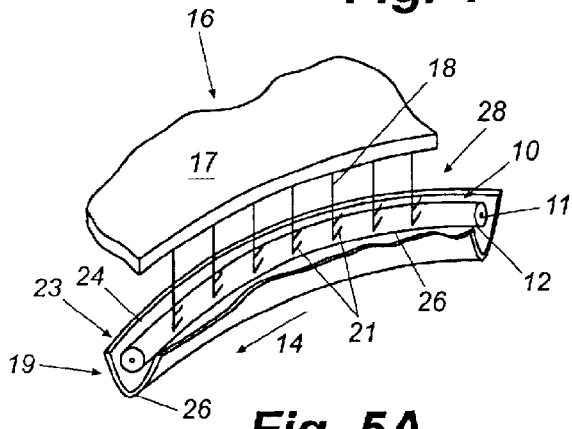
FIG. 5A is a side elevational view with parts broken away, illustrating the engagement of the needles with a yarn passing through an arcuate yarn guide.

The present invention can use a straight, substantially horizontal, flat needle bed 19 (FIG. 4) or a curved needle bed (FIG. 3), such as used in a Fehrer H-1 needle loom. In the use of a curved needle bed, the yarns generally are subjected to about a 0° to 20° angle arc with respect to the needles (FIG. 4), although greater or lesser arcs also can be used as desired. The use of an arcuate bed tends to give a longer stroke of the needles through the yarns and thus typically increases the effectiveness of the needles capturing and pulling fibers through the yarns for interlocking the core and sheath fibers. The needles, because of the curvature of the needle bed, penetrate the yarn at multiple angles within the arc, which increases the fiber interlocking within the fibrous body of the yarns 10 as shown in FIGS. 1 and 5A. This not only increases the effectiveness of the needle penetration and pulling of the fibers, but also accomplishes higher output speeds for yarns processed according to the present invention. Thereafter, upon exiting the needle bed, the yarns proceed through the tensioning rollers 29 (FIGS. 2 and 3) and then are either taken up on individual tubes or cones 31 (FIG. 1) or are grouped together on a warper or beam for further processing.

The dwell time of the needles within the yarn or fiber mass, the speed at which the yarns are advanced through the needle bed and the rate or aggressiveness of the penetrations of the yarn by the needles further can be controlled as needed or desired to provide the finished yarns with certain design properties. For example, the dwell time of the yarn within the needling zone of the yarn and/or the penetration rate of the needles through the yarns can be increased, such as by slowing the advance rate of the yarns per stroke of the needles to less than the spacing of the needles and increasing the rate at which the needles are reciprocated, so that the fibers or filaments thereof are pulled and mixed to a greater extent such that the overall diameter of the finished yarn is significantly increased. Such enhanced bulk is particularly useful for forming lighter weight yarns for use in applications such as blankets or filtration systems where greater bulk or surface area is desirable, or for use in forming fire block barriers using aramid, para-aramids or melamine fibers yarns, such as Basofil®.

Alternatively, various patterns or aesthetic features or effects can be formed in the yarns by varying the feed rate or amount by which the yarns are advanced through the needling zone. For example, the yarns can be formed with a spiral or corkscrew effect by advancing the yarns a distance approximately equivalent to the horizontal spacing between the needles following each stroke of the needle. This effect can be further enhanced or varied by advancing the yarns by some multiple of the needle spacing, i.e., twice the spacing or greater, and by increasing the twist of the yarn being fed from their creels.

Figure 5C:
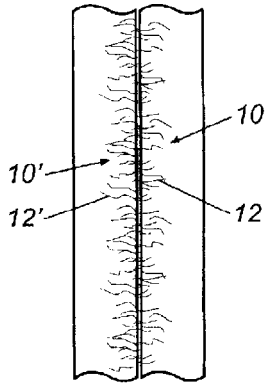
FIG. 5C is a side elevational view of a pair of welded, interlocked yarns according to the present invention.
Figure 5B:
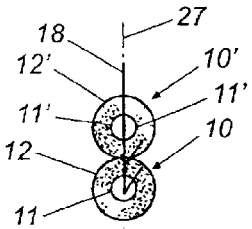
FIG. 5B is an end view illustrating the penetration of a needle into two parallel yarns.

Additionally, the milled grooves 23 of the needle plate further typically are milled to a depth sufficient, and have side walls 24 of a sufficient spacing, such that two or more yarns 10, 10' (FIG. 4) can be fed on top of one another with their centerlines 27 aligned with each other and with a line of needles as indicated in FIG. 4. The penetration of the needles through both of the aligned or parallel stacked yarns causes an intermixing of the fibers of the two yarns 10 and 10' so as to produce a composite yarn that has two yarns welded or joined together along their central axis or center line. The resultant composite yarn has a greater surface area than if the two yarns simply had been plied or spun together (FIGS. 5B–5C). The present invention thus can be used to form welded yarns wherein yarns of different material types are attached or welded together, as opposed to being twisted together to form a multi-ply yarn, as shown in FIG. 5C. For example, to combine a polypropylene yarn having good wicking properties and a cotton yarn with good absorption the yarns are received within their yarn guides with one yarn laid one on top of the other in the yarn guide. As the needles punch through the yarns, they intermix and interlock the fibers to form a side-by-side double strand yarn with each of the yarn components 10 and 10' (FIG. 5C) having more exposed surface area over a conventional twisted multi-ply yarn.

Figure 6:
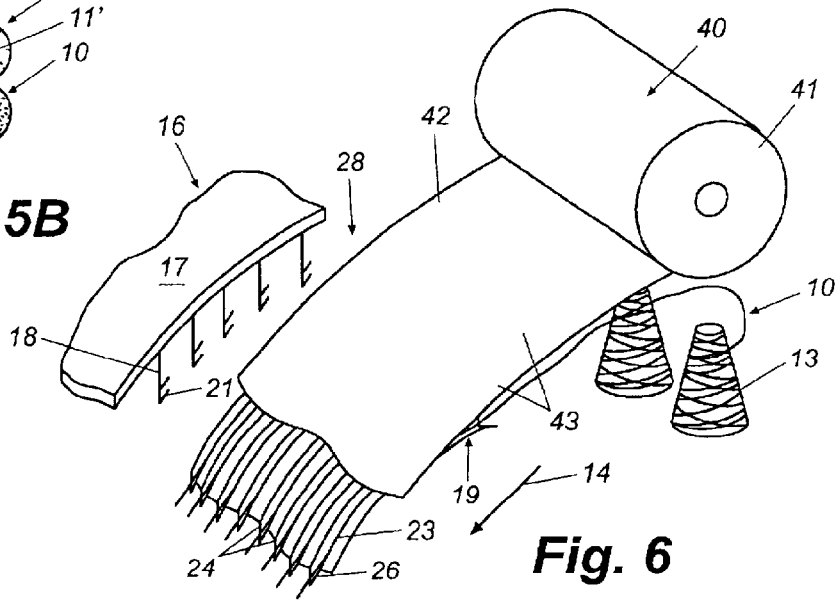
FIG. 6 is a perspective view illustrating an additional embodiment of the present invention in which fibrous mat or web is attached to yarns being passed through the yarn guides.

A further embodiment of the present invention is shown in FIG. 6. In this embodiment, as the yarns are moved through the needle loom, a fiber mass or fabric 40 can be incorporated with the yarns. The fiber mass generally will be formed from natural or synthetic fibers, or a combination thereof, and is fed in a blanket or sheet from a feed roll 41 along the feed path 14 of the looms, the fiber mass 40 will be fed between the needles and the yarns, with the yarns passing along the milled groves of the needle plate bed on which the fiber mass is moved. The yarns are guided into and along the grooved slots in the needle bed and controlled by the positive tension draft placed on each yarn so as to maintain their alignment with the needles. As the needles penetrate through and are drawn out of the fiber mass and yarns, the barbs of the needles engage and pull fibers of the mass 40 and the yarns 10 so that these fibers become intermixed and interlocked to produce a fabric or composite material with increased dimensional stability and desired properties. Additionally, the fabric mass 40 could be split, such as along dashed lines 42, to form separate fibrous strips 43. Each strip can then be incorporated with or become an integral part of the yarns, bringing different desirable properties and characteristics to the yarns.

Yet another example of the present invention is the advancement and perfection of engineered yarns having various specifically designed properties. These yarns incorporate a core of slit film, multi-denier filaments or a textured filament made of polypropylene, nylon, polyester, aramid, rayon, acrylic, or polyethene wrapped or sheathed with fibers of cotton, synthetics, or combinations thereof. These yarns will be processed through the needle loom, wherein the needles of which will penetrate the filament and entangle the wrapper fibers, so that they become a single entity and to substantially ensure that that the sheath fibers will not slide along the axis of the yarn.

The resultant yarns can be used for a variety of uses, such as for mops or making into mats for abrasive pads or other uses, and have increased strength and absorbency, while also exhibiting better abrasiveness and resistance to unraveling and releasing lint. Yarns having high absorption properties, such as cotton yarns, can be combined with yarns having enhanced abrasive properties to provide mop yarns with enhanced liquid absorption and scrubbing properties. The present yarns accordingly are provided with the finished appearance and properties of high end yarns while being capable of being formed by less expensive spinning processes.

EXAMPLE 1

Two yarns were manufactured for Example 1. In the first sample (No. 1), 0.60 cotton count open-end spun (OE) and Dref spun yarns consisting of 34% rayon, 33% polyester, and 33% cotton were formed. The rayon was a 3 denier×2 inch fiber manufactured by Lenzing Corporation. The polyester was a 1.5 denier×1.5 inch length manufactured by KOSA. The cotton was of a mill waste blend with fibers ranging in length from 1 inch to ⅛ inch. These fibers were blended carded, and open-end spun on a 130 mm rotor, Reiter spinning machine with a 4.0 twist multiple. Four ends were then parallel wound on a tube and twisted on an ICBT two for one twister with an S twist.

The second sample (No. 2) consisted of 0.60 cotton count Dref spun and open end spun yarns composed of mill waste cotton, with fiber lengths of 1inch to ⅛ inch and being of a cotton polyester blend. The fibers were prepared as in the previous sample through blending and carding. The fibers were then fed into a Dref II spinning frame and spun with a Z twist comparable to the open-end spun yarn. The yarns were then plied as before with an S twist.

Each type of yarn of each sample was then processed through a Fehrer H-1 needle loom. The yarns of Sample No. 1 were processed at a speed of approximately 40 meters/min with the needles being reciprocated at about 1300 revolutions/min to give a puncture rate of about 1365 needle punctures/meter. The needle bed was formed in an arch design, with the needles generally having a penetration depth of 10 mm and being positioned at varying degrees of penetration about an arc of about +20 to 0 to −20. The preferred needle used was a Foster 15×18×36×3RBAF 0.20 6-4B polished. The needles were arranged in the bed in a straight line and the yarn was guided into the H-1 needle loom by ceramic eyelets that directed the yarn into the milled grooves of the needle plate, which grooves kept the yarns positioned directly under the needles. The yarn was then rewound onto tubes.

The yarns of Sample No. 2 also were processed through a Fehrer H-1 needle loom at 60 meters/min. The needle bed revolutions were 1300/min. totaling 900 needle punches/meter. The same Foster needle was used, however the penetration depth was increased to 14 mm.

A small reeling of each yarn was tied into a bundle having a total length of approximately five inches. One control yarn reeling of a conventional with no needling, one of each of the Sample No. 1 OE and Dref yarns, and one each of the Sample No. 2 OE and Dref yarns were prepared. The sample yarns and control yarns were then placed into the AATCC standard Kenmore washing machine with varying amounts of warm water and ½ cup of Tide household detergent. A different sampling was used for each test.

Wash test of control and Sample Nos. 1 and 2 needle punched OE and Dref spun mop yarns - July 6, 2000

| Sample | No. | color | results |
|---|---|---|---|
| 7 minute agitation in washing machine, medium water level | | | |
| 1..60/4 OE spun | Control | yellow | complete unraveled/partial degradation |
| 2..60/4 OE spun | No. 1 | orange | unravel .25 to .75 inch |
| 3..60/4 OE spun | No. 2 | teal | unravel 1 to 1.5 in |
| A..60/4 Dref spun | Control | none | unraveled and complete degradation |
| B..60/4 Dref spun | No. 1 | black | 0 to .25 inch unraveled |
| C..60/4 Dref spun | No. 2 | Lt. green | .25 to .5 inch unraveled |
| 12–15 minute agitation in washing machine, medium water level | | | |
| 1..60/4 OE spun | Control | yellow | complete degradation |
| 2..60/4 OE spun | No. 1 | orange | 1 to 1.5 inch unraveled approx. ½ inch loss length |
| 3..60/4 OE spun | No. 2 | teal | unravel 1 to 1.5 inch |
| A..60/4 Dref spun | Control | none | complete unravel ⅔ loss of fiber |
| B..60/4 Dref spun | No. 1 | black | unravel .25 to .5 inch loss ½ to 1 inch in length |
| C..60/4 Dref spun | No. 2 | Lt. green | unravel .25 to 1 inch no loss of length |
| 15–20 minute HIGH agitation in washing machine, Low water level | | | |
| 1..60/4 OE spun | Control | yellow | complete degradation, loss of ½ of fiber mass |
| 2..60/4 OE spun | No. 1 | orange | unravel .25 to 2 inch approx. ½ inch loss in length |
| 3..60/4 OE spun | No. 2 | teal | unravel 1 to 2.5 inch, approx. ½ to 1 inch loss in length |
| A..60/4 Dref spun | Control | none | complete degradation, massive fiber loss |
| B..60/4 Dref spun | No. 1 | black | unravel .25 to 1 inch, approx. ½ to 1 inch in length |
| C..60/4 Dref spun | No. 2 | Lt. green | unravel 1 to 2.5 inch, approx. ½ to ¾ inch loss in length |

Conclusion

The open-end spun yarns and Dref spun yarns processed by the present invention out performed the unprocessed, unneedled control yarns with the open-end spun yarn samples exhibiting better resistance to unraveling than the Dref spun yarns. The Dref spun yarns processed with the present invention did, however, still exhibit significantly greater performance and resistance to unraveling and loss of fiber than the open-end yarns of the control sample.

EXAMPLE 2

A yarn of an open-end design was used, composed of 60% Lenzing 3 denier×2 inch rayon fiber blended with 20% Kosa 2 denier×2 inch polyester fiber and 20% Sterling 3 denier×2 inch natural acrylic fiber. The yarns were processed through a fiber control opening line, Crosrol Mark 5 carding machine and spun on a 100 mm rotor to a 1/1 cotton count yarn with a 4.0 twist multiple. Four identical ends were then parallel wound onto a tube and twisted on a Volkman 05 two for one twister.

A portion of this yarn was then processed through a Fehrer H-1 needle loom. The yarn was processed through the loom as before, and was contained within the grooves of the needle bed. The preferred needle was a Groz-Beckard 15×18×38×3 222G. Because of the open-end yarn construction and the smaller size and total yarn mass as compared with Example One, a smaller gauge needle with a more aggressive barb structure was preferred. The yarn traveled through the needling zone at about 10 meters per minute. This yielded an estimated approximately 5410 needle penetrations per meter of yarn with the needles being reciprocated at about 1300 revolutions per minute at about a 13 mm penetration depth.

Three reelings of before needling and after needling yarn samples were prepared. These reelings measured approximately five inches in length and the yarns of each sample were cut at one end to resemble a cut-end mop. The sample reelings were then placed into a standard AATC Kenmore washing machine filled ½ full of warm water and one cup of Tide household detergent. The normal heavy washing agitator cycle was used.

| Sample | Results |
|---|---|
| minute agitation in washing machine, medium water level | |
| ¼ rayon blend without needling | yarn completely untwisted |
| ¼ rayon blend with needling | no change in appearance |
| 10 minute agitation in washing machine, medium water level | |
| ¼ rayon blend without needling | yarn untwisted, some fiber loss |
| ¼ rayon blend with needling | no change in appearance |
| 30 minute agitation in washing machine, medium water level | |
| ¼ rayon blend without needling | yarn untwisted, increasing fiber loss |
| ¼ rayon blend with needling | no change in appearance |

Conclusion

The ¼ rayon blend yarn is a generally preferred yarn in the janitorial field for the application of floor finishes. This application, however, requires the mop to release little, if any lint. This test thus shows how the needling process of the present invention greatly improved the performance of this yarn in not only in the degree of linting but also increasing the life of the mop.

It will be understood by those skilled in the art that while the invention has been described above with reference to certain embodiments and examples, numerous changes, additions and modifications can be made and various equivalents substituted without departing from the spirit and scope of the invention as set forth in the following claims.

What is claimed is:

1. An engineered spun yarn comprising a first yarn including a series of spun fibers about three inches or less in length and a second yarn, the first and second yarns each including at least one of the following: natural fibers, synthetic fibers and a combination of natural and synthetic fibers, and further comprising at least one core fiber wrapped with at least one sheath fiber, wherein the first and second yarns are positioned adjacent and parallel to each other such that the core and sheath fibers of each yarn are engaged by needles arranged to penetrate approximately through a centerline of each yarn so as to penetrate and engage the core and sheath fibers and cause the core and sheath fibers of each yarn to substantially intermix as the needles move therethrough to provide the fibers of the engineered yarn with enhanced resistance to unraveling, resistance to linting, an increase in bulk or desired aesthetic properties.

2. The yarn of claim 1 and wherein the first and second yarns each have different material properties such that the composite yarn includes the different material properties of both yarns.

3. The yarn of claim 1 and wherein the core and sheath fibers of at least one of the first and second yarns each have different material properties to produce a composite yarn incorporating such different material properties.

4. The yarn of claim 3 and wherein the fibers of of at least one of the first and second yarns include fibers having enhanced liquid absorption properties and fibers having enhanced abrasive properties.

5. The yarn of claim 1 and wherein the yarn comprises a Dref yarn.

6. The yarn of claim 1 and wherein the yarn comprises an open-end spun yarn.

7. The yarn of claim 1 and wherein the yarn comprises a ring spun yarn.

8. The yarn of claim 1 and wherein the yarn comprises a vortex spun yarn.

9. The yarn of claim 1 and wherein the yarn comprises a worsted spun yarn.

10. The yarn of claim 1 and wherein the yarn comprises a worsted carded fibrous mass.

11. A yarn bundle having improved material properties, including enhanced resistance to unraveling and linting, the yarn bundle comprising spun yarns each comprising a series of fibers, each of a length of about three inches or less and selected from at least one of a series of natural fibers, synthetic fibers, or a combination of natural and synthetic fibers, the yarn bundle being subjected to a needling process wherein the fibers thereof are engaged and penetrated by a series of needles such that the fibers of the yarn bundle are intermixed to form the yarn and wherein the yarn fibers are twisted prior to needling to lock in twist of the yarn without heat setting.

12. The yarn bundle of claim 11 and wherein the yarn bundle comprises a composite yarn including a first yarn and a second yarn each consisting essentially of natural fibers, synthetic fibers or a combination thereof, the yarns positioned adjacent and parallel to each other such that the needles penetrate approximately through the centerline of both yarns so that the fibers of the first yarn are intermixed with the fibers of the second yarn to weld the yarns together to form the composite yarn.

13. The yarn bundle of claim 12 and wherein the first and second yarns each have different material properties such that the composite yarn includes the different material properties of both yarns.

14. The yarn bundle of claim 11 and wherein the fibers of the yarn bundle are engaged by the needles and the yarn bundle is advanced at a predetermined rate and distance between strokes of the needles during the needling process to create a desired aesthetic appearance for the yarn.

15. The yarn bundle of claim 11 and further comprising a fibrous web attached to the yarn bundle by the engagement of fibers of the fibrous web with the series of needles during the needling process whereby the fibers of the fibrous web and the fibers of the yarn bundle are intermixed.

16. A spun composite yarn, comprising a first yarn and a second yarn, each comprising core and sheath fibers formed from synthetic fibers, natural fibers or a combination thereof, with the core and sheath fibers of each yarn having different desired performance or aesthetic properties, said first and second yarns each being twisted and arranged in a parallel relationship, and subjected to a needling operation wherein a series of needles penetrate said first and second yarns, approximately through centerlines thereof, to substantially intermix said fibers of said yarns and weld said yarns together to form the composite yarn having combined performance or aesthetic properties of both said first and second yarns.

* * * * *